US005861587A

United States Patent [19]

Powell et al.

[11] Patent Number: 5,861,587

[45] Date of Patent: Jan. 19, 1999

[54] METHOD FOR OPERATING A DOUBLE DECK ELEVATOR CAR

[75] Inventors: Bruce A. Powell, Canton; Joseph C. Walker, Avon, both of Conn.

[73] Assignee: Otis Elevator Company, Farmington, Conn.

[21] Appl. No.: 978,947

[22] Filed: Nov. 26, 1997

[51] Int. Cl.[6] ..... B66B 1/18; B66B 1/28; B66B 1/00

[52] U.S. Cl. ..... 187/382; 187/902; 187/249

[58] Field of Search ..... 182/382, 381, 182/384, 902, 249

[56] References Cited

U.S. PATENT DOCUMENTS

| | | | |
|---|---|---|---|
| 4,299,309 | 11/1981 | Bittar et al. | 187/392 |
| 4,632,224 | 12/1986 | Nowak et al. | 187/387 |
| 5,086,883 | 2/1992 | Schroder | 187/258 |
| 5,345,049 | 9/1994 | Bajat et al. | 187/382 |

*Primary Examiner*—Robert E. Nappi

[57] ABSTRACT

A method of operating a double deck elevator system when the trailing elevator deck (26,28) is empty, whereby the leading deck answers all registered hall calls except upon the occurrence of certain conditions.

3 Claims, 1 Drawing Sheet

| | DIRECTION OF ELEVATOR | LOWER DECK CAR CALLS | | UPPER DECK CAR CALLS N | UPPER DECK CAR CALLS N+1 | HALL CALLS N | HALL CALLS N+1 | UPPER DECK STOP FLOOR | |
|---|---|---|---|---|---|---|---|---|---|
| A | UP | NONE, DECK EMPTY | | X | ANY | ANY | ANY | N | A |
| B | | | | – | – | X | X | N+1 | B |
| C | | | | – | X | X | – | N+1 | C |
| D | | | | ANY | – | X | – | N | D |
| | | N | N−1 | | | N | N−1 | | |
| E | DOWN | X | ANY | NONE, DECK EMPTY | | ANY | ANY | N+1 | E |
| F | | – | – | | | X | X | N | F |
| G | | – | X | | | X | – | N | G |
| H | | ANY | – | | | X | – | N+1 | H |

| | DIRECTION OF ELEVATOR | LOWER DECK CAR CALLS | | UPPER DECK CAR CALLS N | UPPER DECK CAR CALLS N+1 | HALL CALLS N | HALL CALLS N+1 | UPPER DECK STOP FLOOR | |
|---|---|---|---|---|---|---|---|---|---|
| A | UP | NONE, DECK EMPTY | | X | ANY | ANY | ANY | N | A |
| B | | | | – | – | X | X | N+1 | B |
| C | | | | – | X | X | – | N+1 | C |
| D | | | | ANY | – | X | – | N | D |
| | | N | N−1 | | | N | N−1 | | |
| E | DOWN | X | ANY | NONE, DECK EMPTY | | ANY | ANY | N+1 | E |
| F | | – | – | | | X | X | N | F |
| G | | – | X | | | X | – | N | G |
| H | | ANY | – | | | X | – | N+1 | H |

METHOD FOR OPERATING A DOUBLE DECK ELEVATOR CAR

TECHNICAL FIELD

The present invention relates to a method for operating a double deck elevator car.

BACKGROUND OF THE INVENTION

The use of double deck elevator cars in high-rise, high-capacity buildings is well known. Such cars, particularly during the up-peak morning rush of passengers, are particularly effective in quickly and efficiently moving passengers to their destination floors.

One feature of the double deck elevator system described above is that, on occasion, the elevator car may stop to service a hall call or to discharge a passenger at a destination floor from one deck, while passengers on the other deck are still awaiting arrival at their destination floor. In such case, the non-served deck elevator doors remain closed and the passengers on the non-served deck must wait until the other deck has received or discharged its passengers.

Although these intermediate stops may not, in actual fact, lengthen the overall entry-to-arrival trip time for the passengers on either deck, the passengers on the non-served deck may experience dissatisfaction as the elevator repeatedly halts without any obvious (to them) discharge or acceptance of passengers. Systems in use today often include a visual indication in the non-served car to inform the passengers. However, the subjective dissatisfaction may still remain.

DISCLOSURE OF THE INVENTION

It is an object of the present invention to reduce the number of stops in a double deck elevator car.

It is further an object of the present invention to reduce the number of stops in an occupied double deck elevator car at which passengers enter or exit one elevator deck while passengers on the other deck are forced to wait.

The present invention provides a method of operating a double deck elevator system wherein the car is operated to answer hall calls with the leading deck instead of the trailing deck during periods of operation wherein the trailing deck is unoccupied.

The present invention, by serving hall calls with its leading, occupied, deck avoids adding passengers in the unoccupied, trailing deck and thus reduces the chance that passengers may experience an unopened-door stop. In the event the combination of car and hall calls of adjacent floors can be answered by a single car stop, the method according to the present invention returns the control of the car to the prior art operating method wherein the trailing deck is directed to answer all unanswered hall calls.

The foregoing and other objects, features and advantages of the present invention will become more apparent in light of the following detailed description of the exemplary embodiments thereof, as illustrated in the accompanying drawings.

BEST MODE FOR CARRYING OUT THE INVENTION

Figures 1, 2:
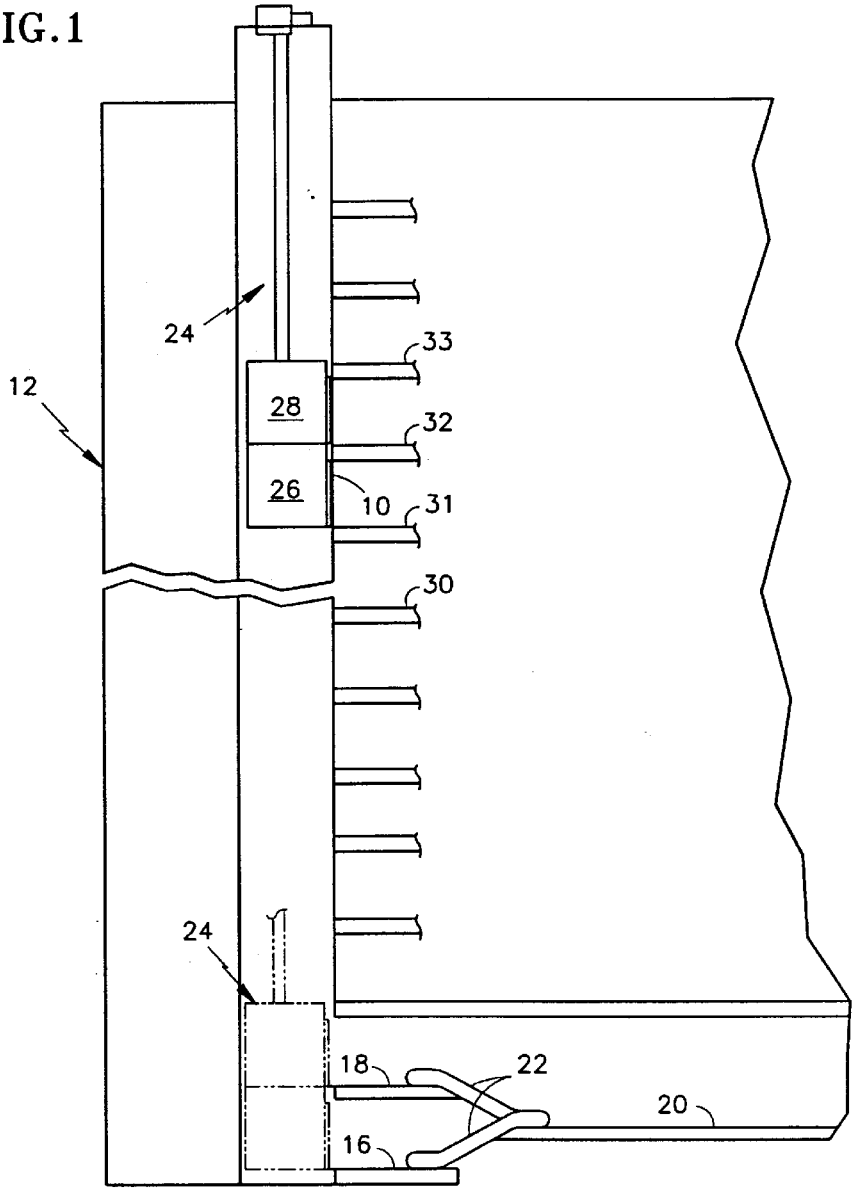
FIG. 1 shows a schematic representation of a building and an elevator hoistway using a double deck elevator car.
FIG. 2 shows a logic diagram for the method according to the present invention during periods when the trailing deck is unoccupied.

Referring now to the drawing Figures, and in particular to FIG. 1, an elevator hoistway 10 is shown disposed within a building 12 and running from a lower entrance lobby level 20 to the upper building floors 30, 31, 32, 33, etc. As is typical in double deck elevator systems, the lower lobby 20 is, in reality, a dual level lobby having lower and upper elevator entry levels 16, 18. Upon entering the building lobby level 20, passengers are directed to different elevator entry lobby levels 16, 18 based upon their ultimate destination, for example, odd numbered floor destinations to lobby level 16, even number floor destinations to lobby level 18. As the elevator car 24 services the lower lobbies 16, 18, passengers on the lower and upper lobbies 16, 18 enter corresponding upper and lower elevator car decks 26, 28. During morning up-peak service, the elevator car 24 thus delivers passengers to the upper floors by stopping no more frequently than at two floor increments. Thus, passengers in route to even numbered floor 32 would be directed to the upper lobby level 18 and enter the upper car deck 28, while passengers seeking to travel to odd numbered floor 31 would enter the lower car deck 26 from lobby level 16. Car 24, operating during the up-peak hours when the greatest number of passengers wish to move from the lobby entrance 20 to the upper floors, would thus service both floors 31 and 32 by means of a single stop.

Passengers at the upper floors may wish to travel downward at various times during the day or to travel between intermediate floors within the building. In responding to hall calls entered by the passengers in either an up or down direction and depending upon the passenger's desired destination, prior art methods of controlling double deck elevator systems cause the trailing deck to respond to the individual hall calls. Thus, in the downward direction, the upper deck would answer downward direction hall calls and, vice versa, the lower deck 26 would service floors having an up direction hall call registered. This prior art method of operation has the benefit of both answering the registered hall call in a timely fashion, but also being positioned so as to answer any new hall cal that might very soon be registered at the next adjacent floor by the leading elevator deck.

Such systems also have the drawback, in particular, for upwardly moving elevators having occupied upper decks, of causing the elevator to stop under circumstances wherein the upper deck elevator doors remained closed while the lower elevator deck accepts or discharges passengers from an intermediate floor. As noted above, passengers may become dissatisfied or experience anxiety if required to wait in a closed, non-moving elevator car. Such stops may also allow passengers to develop a perception of extended trip time or inadequate elevator operation, even though the overall trip time of any individual passenger has not been increased, and may, in fact, have been reduced.

The present invention avoids these shortcomings by utilizing the leading deck to answer all hall calls in the event the trailing deck is unoccupied. By using the upper deck to respond to unanswered hall calls, the present invention concentrates passenger occupancy in the leading deck, particularly during periods of off-peak operation when the demand on the elevator system is light. Passengers riding on the occupied upper deck, for upward direction travel, still experience the same number of stops as the elevator services unanswered hall calls. However, each stop is accompanied with a corresponding opening of the elevator doors and the acceptance and/or discharge of passengers.

In order to maintain system efficiency and to continue to utilize the full benefits of the double deck elevator design, there are two exceptions to the above rule requiring the use the leading deck during periods of time when the trailing deck is unoccupied. These exceptions would occur in the event of the elevator controller recognizing two unanswered and adjacent hall calls, or in the event of the elevator car operating panel registering an elevator car call at the next most adjacent floor to the next hall call.

Under either of these two preceding circumstances, the leading elevator deck would bypass the next hall call, moving so as to register with the next adjacent floor, thereby serving the next adjacent hall call under the first exception, or discharging its upper deck passengers on the next adjacent destination floor while simultaneously serving the preceding floor hall call with the trailing deck under the second exception. Although such exceptions now result in passengers in both decks of the elevator car, the ability to operate as a single deck elevator during periods of light operation provides enhanced passenger satisfaction, while retaining and, under the appropriate circumstances, using the higher capacity of the double deck elevator to reduce or eliminate unwanted stops.

It will further be appreciated by those skilled in the art that the absence of passengers in the trailing deck may occur at any point over the elevator car's span of activity. Thus, the method according to the present invention, may be implemented at any time the control system recognizes an empty trailing deck. Such detection or recognition may be accomplished by a variety of methods or means, including, by way of example, passenger detecting devices using optical, heat sensing, weight sensing means, or other means for detecting human presence within the elevator car, or, preferably, by use of the simple technique of monitoring the existence of car calls on each deck's car operating panel. The absence of car calls on a particular deck is a strong, if not conclusive, indication of the absence of passengers on that particular deck.

Referring now to FIG. 2, a logic diagram indicating operation of the method of the present invention in response to the presence or absence of car and hall calls is shown. Each line shows the method's response to a different combination of hall and/or car calls during periods with no passengers in the trailing deck. The presence or absence of calls are illustrated by and "X" or a "—" respectively, with the term "ANY" used to represent the occurrence of either. As in the text of this specification, N, N+1 and N−1 identify the floor levels 30–33 of the building 12.

Thus, as shown by Line A, in the up direction and in the absence of any lower deck car calls, the upper deck will stop at floor N in response to an upper deck car call for floor N regardless of any other combination of car or hall calls as shown. Line D further illustrates operation according to the present invention, wherein, for an up direction hall call at floor N in the absence of adjacent car or hall calls, the upper deck of the car again stops at floor N.

Lines B and C illustrate the exceptions to the operation of the system according to the present invention wherein on Line B adjacent up hall calls at floors N and N+1 result in the upper deck stopping at floor N+1 and both calls being served simultaneously by the elevator at a single stop. Line C, the other exception, again stops the upper deck at the N+1 floor in response to an upper deck car call at floor N+1 and an up hall call at the floor N as shown. Line C thus again illustrates the serving of two calls on adjacent floors with a single elevator car stop. The down direction, illustrated by lines E, F, G and H, mirrors the up direction operation discussed above but with now the trailing upper deck empty of passengers.

The present invention thus provides a method for operating a double deck elevator which, during periods of operation when, for one reason or another, the trailing deck has no passengers present, for reducing the number of stops during which passengers on one deck are caused to wait for the other deck of the elevator car to receive or discharge passengers. This advantageous operation, which improves the subjective satisfaction of the elevator passengers, continues until the occurrence of one of the two recited exceptions at which time the method according to the present invention operates the elevator car in the most efficient manner.

Both these and other objects and advantages of the present invention will be apparent to those skilled in the art upon review of the foregoing specification and the appended claims and drawing Figures.

What is claimed is:

1. In a double deck elevator operable in an upward direction, said upward direction defining a corresponding leading deck and a trailing deck of said elevator, said elevator further being operable in response to upward direction hall calls at a plurality of floors input by waiting passengers and car destination calls input by riding passengers on one or both decks, a method for operating said elevator to service intermediate floors during periods when the trailing deck is empty, comprising the step of:

answering all upward direction hall calls for said elevator by the leading deck, except upon occurrence of at least one of the following conditions:

a) wherein a first, next upward direction hall call at a first floor occurs concurrently with a second unanswered hall call at the next upwardly sequential floor, or b) wherein a next upward direction hall call at a first floor occurs concurrently with a car destination call for the next upwardly sequential floor.

2. In a double deck elevator operable in an upward direction and a downward direction, each operating direction defining a corresponding leading deck and a trailing deck of said elevator, said elevator further being operable in response to upward and downward direction hall calls at a plurality of floors input by waiting passengers and car destination calls input by riding passengers on one or both decks, a method for operating said elevator comprising the steps of:

determining the absence of passengers on the trailing deck of said elevator, and in response to said absence of said passengers performing the step of:

answering all hall calls for said elevator's current operating direction by the leading deck, except upon the occurrence of at least one of the following conditions:

a) wherein a first hall call at a first floor occurs concurrently with a second hall call at the next sequential floor, or b) wherein a next hall call at a first floor occurs concurrently with a car destination call for the next sequential floor.

3. The method as recited in claim 2, wherein the method of determining the absence of passengers on the trailing deck includes the steps of:

monitoring the occurrence of car destination calls registered on the trailing deck, and determining, in response to the absence of car calls registered on the trailing deck, the absence of passengers on the trailing deck.

* * * * *